US008926229B1

(12) United States Patent
Clair

(10) Patent No.: US 8,926,229 B1
(45) Date of Patent: Jan. 6, 2015

(54) TRENCH BOX DEWATERING SYSTEM

(76) Inventor: Bruce Alan Clair, Marshfield, MO (US)

( * ) Notice: Subject to any disclaimer, the term of this patent is extended or adjusted under 35 U.S.C. 154(b) by 345 days.

(21) Appl. No.: 13/231,006

(22) Filed: Sep. 13, 2011

(51) Int. Cl.
*E21D 5/00* (2006.01)

(52) U.S. Cl.
USPC ..... 405/283; 405/282

(58) Field of Classification Search
USPC ..... 405/272, 282, 283; 37/317, 318, 320
See application file for complete search history.

(56) References Cited

U.S. PATENT DOCUMENTS

| | | | | | |
|---|---|---|---|---|---|
| 3,608,320 | A * | 9/1971 | Filak | ..... | 405/225 |
| 3,715,889 | A * | 2/1973 | Bixler et al. | ..... | 405/283 |
| 3,782,125 | A * | 1/1974 | Holl | ..... | 405/282 |
| 4,058,983 | A * | 11/1977 | Griswold | ..... | 405/283 |
| 2008/0044232 | A1 * | 2/2008 | Lauscher | ..... | 405/155 |

* cited by examiner

*Primary Examiner* — Sean Andrish
(74) *Attorney, Agent, or Firm* — Daniel S. Polley, P.A.

(57) ABSTRACT

A dewatering system built onto trench shoring boxes and equipment for removing and pumping ground water from ditches or trenches excavated to install underground utility pipes and equipment. Ground water is pulled from the trench bottom by the dewatering system through slotted openings at the bottom of the trench shoring equipment and through the attached suction tubes. The suction tubes are attached to a pump at the top of the trench shoring equipment.

21 Claims, 5 Drawing Sheets

TRENCH BOX DEWATERING SYSTEM

FIELD OF THE INVENTION

The present invention is directed to a dewatering system on trench shoring equipment, such as, but not limited to trench boxes used in earth excavations for the installation of pipelines, structures and the equipment of water, sewer, drainage, gas and other sub surface utilities.

BACKGROUND OF THE INVENTION

A trench box or shoring equipment is used in some excavations up to five feet deep and is used in most all excavations over five feet deep, as soil conditions are required under Occupational Safety and Health Administration ("OSHA") classification. The purpose of the trench box is to prevent the earth walls of a trench, if they should collapse, from falling on workers. A typical trench box has two sides or walls attached to each other with large pipes called spreader bars and openings at either end of the walls. These openings are in place to allow the trench box to stay in the trench, as the excavating equipment removes earth from the front end of the box; the box is pulled forward in the newly excavated trench. The pipe and equipment installation is performed within the walls of the box and the rear opening allows the installed pipe to pass through the box and under the spreader bars as the box is pulled forward. Other types of trench boxes may have three or four walls and are placed in excavations in a single location for the installation of large equipment or structures.

Trench boxes are available in various sizes as needed for the working conditions and to meet OSHA safety requirements. The length of the trench box is chosen based on the length of the pipe or equipment installed. The width is also chosen based on pipe and equipment width and is adjusted by changing the length of the spreader bars. The height of a trench box typically ranges from 4' to 10' for a single unit. For excavations requiring additional heights, trench boxes are available in a stacking system to accommodate depths over that of a single unit. The thickness of the trench box walls typically range from four to eight inches and the bottom edges are typically angled to a point at forty five degrees, which helps with anchoring the bottom of the box in the trench and cutting through the earth as it is pulled in the trench.

The typical operation consists of the trench box or other shoring devices placed within a trench excavation. Workers enter the trench box and work within its limits to install the pipe or equipment. As installation is performed, soils may be prepared or replaced to provide a stable foundation for the pipe and equipment. These operations can take place where subsurface ground water is present and in some cases the ground water can be several feet above the bottom of the excavation. This water must be removed to allow for the pipe and equipment installation. The water removal or dewatering is presently accomplished with varying styles of pumps and suction hoses as determined by the type of soil conditions. The installation of these dewatering systems is time consuming which greatly increases the overall installation cost of an underground utility system. The dewatering is also problematic, especially in a hard or rocky type of ground condition. In this condition a deeper excavation is installed within the trench box to accommodate a pump head or suction screen end from a pump hose, to a depth below the working grade of the pipe installation. In many cases, these single depressions and pump ends plug with debris or soil and may not keep up with the amount of ground water that is present, which requires additional pumps and additional labor to monitor the pump ends.

The activity of placing pump ends or suction screens consists of draping a suction hose from a pump over the trench box wall, with its end or suction screen extended to the bottom of the trench. This activity has to be repeated every time the trench box is moved to the next section, which is typically every thirteen to twenty feet and consists of removing the suction hose and moving the pump if needed and replacing the suction hose and setting the suction hose end or screen in a proper location to allow for the installation of the pipe and equipment. In many cases, the amount of time and labor required for moving and setting of pump hoses and monitoring to maintain a safe work environment and proper function of the pumps can exceed the time that is spent in the actual installation of utility pipes or equipment.

The pump hoses hanging in the trench box also creates a safety issue for workers inside of the trench box, as the hanging hoses become an added obstacle to avoid while working and to contend with, when lower and setting pipe and equipment into the trench box. An additional hazard to workers in the trench is created during the raising or lowering of the pump suction hoses in and out of the trench box with the attached suction ends or screens. This hazard is increased with the weight of the pump hoses and the process of removing and resetting them being, repeated several times during the work day.

SUMMARY OF THE INVENTION

The present invention generally provides a novel assembly or system for removing ground water from excavations which is incorporated into the design of the trench box or similar structure. The trench box dewatering system of the present invention preferably comprises a suction screen along, the bottom of the trench box walls, which can be permanently disposed. The suction screen can be in fluid communication with a preferably built-in suction tube on one end of the trench box wall connecting the suction screen at the bottom of the wall to a pump connection at the top of the wall.

The present invention system can be provided with additional connections at the top of the suction tube to connect one wall to another for the use of a single pump and capping any unused connections or using multiple pumps, such as a pump on each wall for conditions with heavy ground water. This system can at least reduce, if not eliminate, the need for using pump heads or suction screens with a pump suction hose. The system also reduces, if not eliminate, the time and labor to install and monitor these pump ends in the excavation and the working hazard of using pump hoses within the work area of the trench box.

The suction screen can be comprised of a small cavity along the bottom of the trench box walls and can preferably run the entire length of the wall within its designed shaped, whether squared or with an angle. Small openings or slits can be provided to pull the ground water in, from the bottom of the trench, through this screen and through the suction tube to the connected pump. The pump can sit on the ground a few feet from the trench and can be pulled by machinery or labor as the trench box is moved. Alternatively, the pump can be attached to the outside of the trench box by a conventional securement mechanism. In one embodiment, the pump can be connected to the top of the trench box with a typical flexible pump hose. The trench box dewatering system of the present invention used on a trench box can preferably place the suction screens below the working grade of the pipe and equipment installation.

The trench box bottom with suction screens can preferably sit on or adjacent the bottom of the trench excavation and with an average of about six inches of bedding gravel or drain rock placed in the trench bottom as the standard practice for installing pipe and equipment at a desired grade or elevation will maintain the suction screens below the working grade. This helps to keep the ground water below the work area and with the amount of additional suction screen provided by the dewatering system, the chance of debris or soil plugging or stopping the pump system would be at least reduced, if not eliminated as common with standard pumps ends, typically four to eight inches.

The present invention system can be added or retrofitted to an existing trench box or installed during manufacturing and can be used on any size or style of trench box or shoring equipment.

DETAILED DESCRIPTION OF THE PREFERRED EMBODIMENTS

Figure 1:
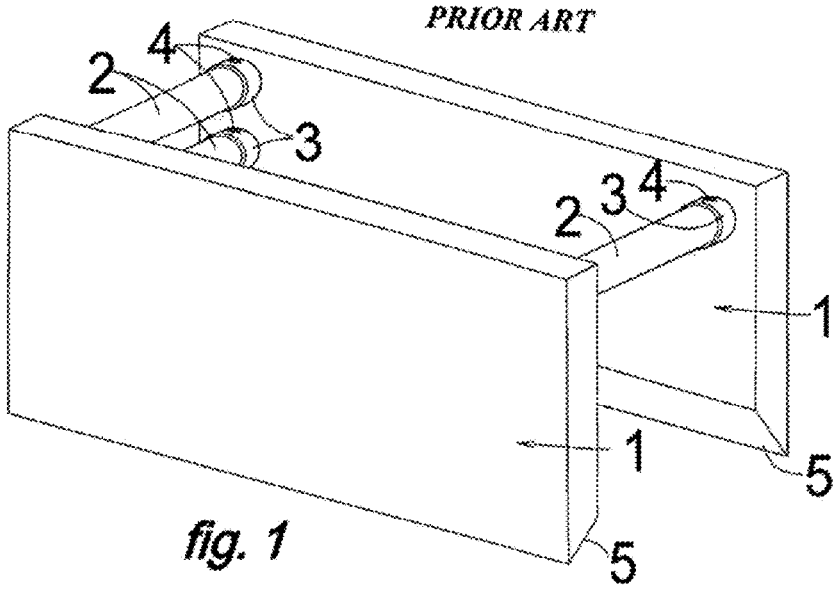
FIG. 1 is a perspective view of a standard trench box.

FIG. 1 of the drawings illustrates a standard trench box that is typically used for shoring trench walls and providing safety within an earth excavation. The trench box is one of several types of shoring devices and it consists of steel walls 1 with varying thickness, heights and lengths as would be needed for a particular application. Spreader bars 2 consist of steel pipes that separate and connect the trench box walls together. They are connected to each wall by inserting into a sleeve 3 attached to the wall and held in place with pins 4. The spreader bars 2 also come in varying lengths as would be required for the width of excavation needed. The bottom of most trench box walls 1 are angle to a point 5 to help anchor the walls in the bottom of the trench and to cut through the earth as it's moved forward, by pushing or pulling with the excavating machinery, to the newly excavated trench area.

The dewatering system of the present invention described in more detail below can be installed on any type of trench shoring device that uses sheets, preferably made from steel, or panels to brace the earth walls of an excavation. Its function provides the most benefits to the trench box which is moved frequently as the trench excavation progresses and for illustration purposes, all drawings represent the dewatering system installed on a trench box. However, it is considered within the scope of the present invention to use the dewatering system with various types of shoring devices.

Figure 2:
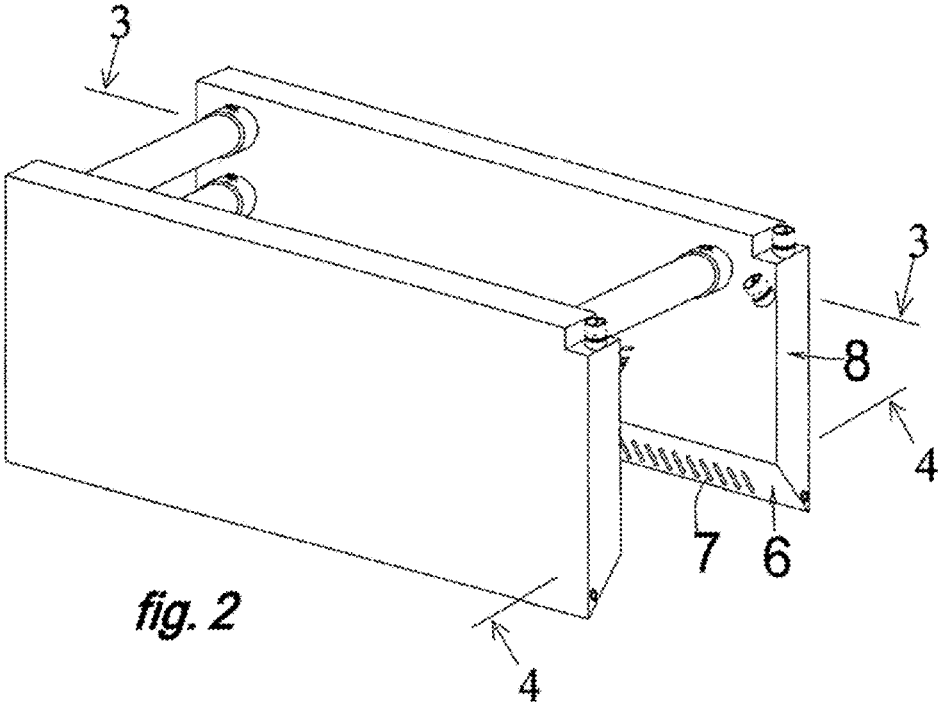
FIG. 2 is a perspective view of a trench box with the dewatering system in accordance with the present invention.
Figure 3:
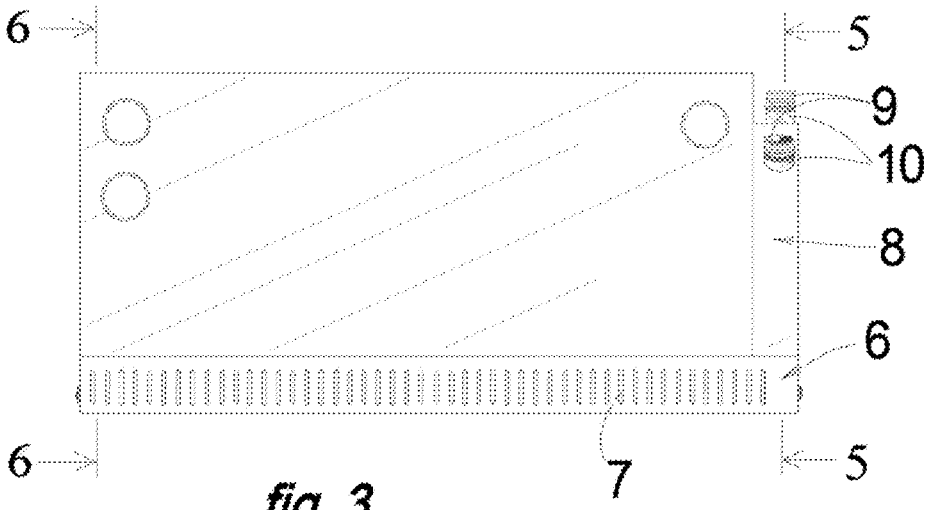
FIG. 3 is an inside elevation view of the present invention trench box wall with dewatering system taken along line 3-3 of FIG. 2.
Figure 4:
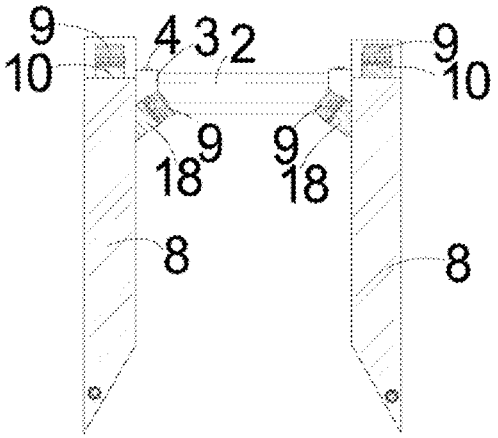
FIG. 4 is an end elevation view of the present invention trench box with dewatering system taken along line 4-4 of FIG. 2.

FIGS. 2 to 4 illustrates the dewatering system with its suction screen 6 that can run along at least a portion of the bottom of each wall and preferably a majority if not all of the bottom. The screen can include a cavity within at least a portion of the bottom of the wall and one or more openings within a front wall (which is preferably angled similar to the angled bottom of a conventional trench box). The one or more openings preferably can be a plurality of small openings 7 or slits where the ground water, in the bottom of the trench, is pulled into the suction screen cavity through the openings 7 by a pump that is attached to the dewatering system. The pump type and size is not considered limiting aid can be chosen by the user, based upon ground and water conditions they are working in. Each suction screen can be provided with a suction tube 8 that runs vertically up the end of the wall or panel and also consists of a cavity within the walls and which can have an open connection to or communication with the suction screen for the ground water to travel from the screen cavity and up the suction tube to a connected pump. The connected pump can be preferably attached to the suction tube near the top of the wall or panel with a standard connection, such as, but not limited to, a cam lock coupling 9 or any type of hose coupling that may be preferred for the pump or pumps to be used. The cam lock or hose couplings can be provided with a threaded end and are screwed onto the end of a short threaded pipe 10 attached to the suction tube 8. The couplings 9 and threaded ends 10 can be preferably located just below the top of the trench box and behind the spreader bar as best shown in FIG. 4 to prevent damage during use and transport.

Figure 5:
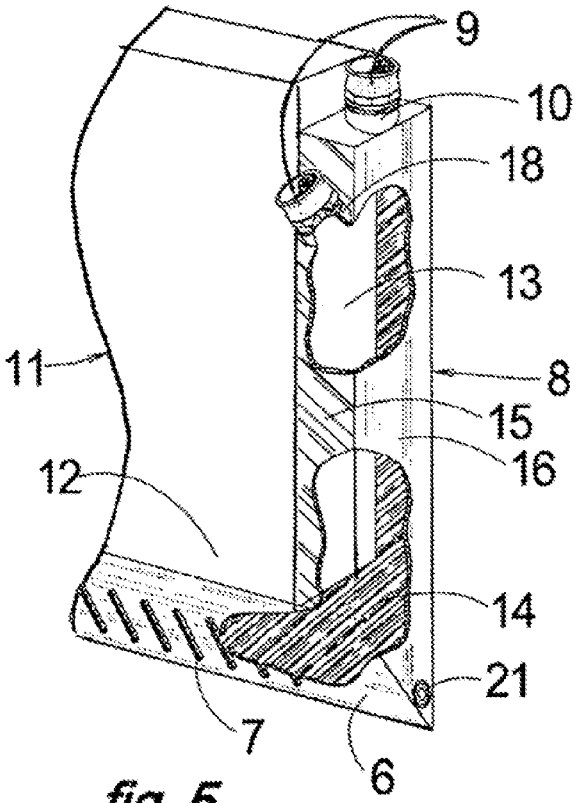
FIG. 5 is an enlarged partial cut-away view taken along line 5-5 of FIG. 3.

FIG. 5 illustrates the cavities within the suction screen 6 and suction tube 8 of the dewatering system of the present invention as it could be installed on a trench box wall or shoring panel during manufacturing. The trench box wall or panel 11 would be a separate unit with an interior bottom 12 or floor and an interior end wall 13 within the suction screen 6 and the suction tube 8. The back wall 14 could be a single unit encompassing the trench box wall with the back of the suction screen and suction tube or could consist of multiple sections with one piece for the back of the trench box wall and one or two additional pieces for the back of the suction tube and screen. The suction screen 6 can be comprised of a single section with appropriately sized and designed openings 7 and attached to the front of the trench box and to the back panel to create the desired angle typically used for trench box and shoring panel bottoms. The suction tube 8 can be comprised of three additional sections serving as the front 15 and side 16 and top panels. These sections can be connected together as shown in FIG. 5 and connected to the back panel 14, suction screen 6 and the end of the trench box wall 13 to form a single enclosed cavity within the suction screen and tube.

Figure 6:
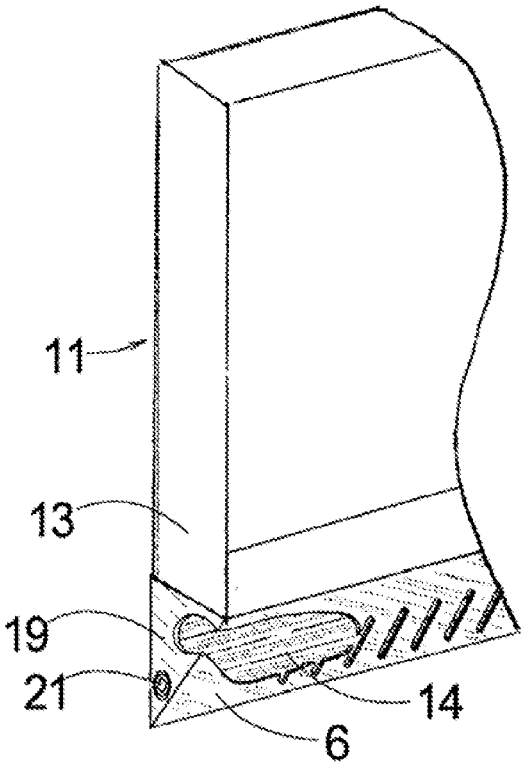
FIG. 6 is an enlarged partial cut away view taken along line 6-6 of FIG. 3.

The top of each suction tube can include one threaded pipe 10 attached to the top of the suction tube and a second threaded pipe 18 attached at a slight upward angle to the inside of the suction tube. Each threaded pipe can be connected to the suction tube 8 with an inside opening that access's the cavity within the suction tube 8 and can be fitted with a pump hose coupling 9 or fitting of choice. On the end of the trench box or panel wall opposite of the suction tube, the suction screen preferably ends flush with the wall 11 or panel as shown in FIG. 6 and can contain an end section 19 connected to suction screen 6 and back panel 14 and to the bottom of the end panel 13 of the trench box wall to close in the cavity within the suction screen 6.

Figure 7:
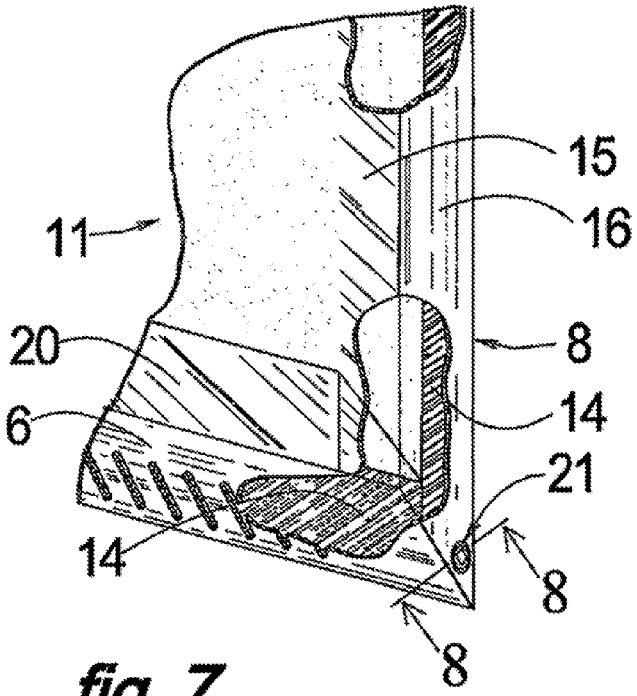
FIG. 7 is an enlarged partial cut-away view of a portion of FIG. 5 illustrating the present invention dewatering system retrofitted to an existing trench box wall.

The dewatering system of the present invention can be retrofitted to an existing panel or trench box wall with a flat bottom and preferably includes the sections as listed above with the exception of the back wall 14. The back could comprise one or two smaller sections connected to the existing trench box wall 11 at an end and the bottom in order to create the cavity within the suction screen and tube. The present invention system can also be retrofitted to a trench box wall with an angled bottom as shown in FIG. 7 with the addition of a front section 20 above the suction screen 6. This section can have a height preferably equal to the overall height of the angled bottom and can connect to the bottom of the trench box wall 11, the top of the suction screen 6 and to the suction tube front section 15. This type of retrofit could also include an additional size and shape to the end panel 19 shown in FIG. 6 to accommodate the area and shape of the angled bottom and form a fit to close in the end of the suction screen cavity.

Figure 8:
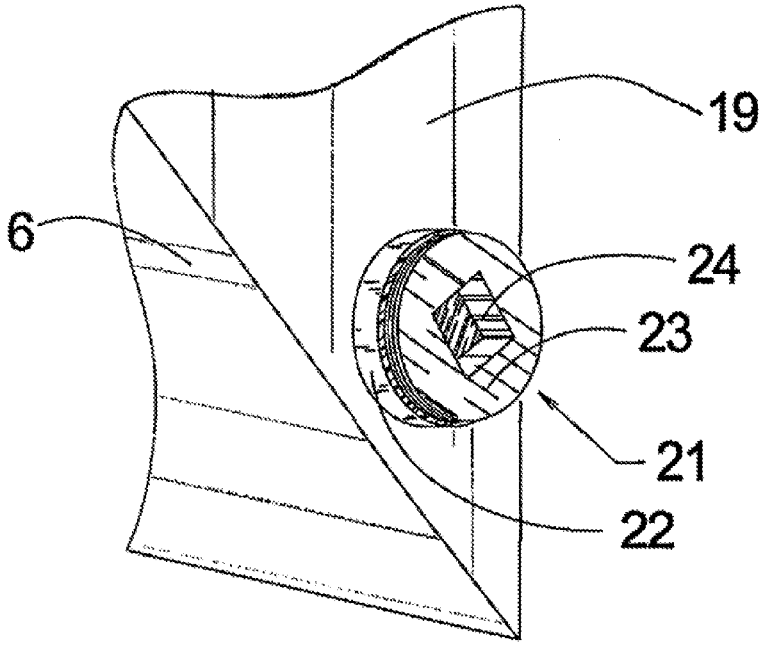
FIG. 8 is an enlarged view taken along line 8-8 of FIG. 7.

FIG. 8 details a clean out plug 21 preferably located at least one end, and preferably at each end, of the trench box wall or panel on a bottom portion of the suction tube side section 16 and/or the end section 19 for the purpose of cleaning or washing out sand that may enter the suction screen after extended use. The clean out plug can comprise a female threaded pipe or coupling 22 attached to each section with an opening to the cavity within the suction screen 6. A threaded plug 23 can be screwed into each coupling and can be provided with a recessed or extended nut 24 for removing and replacing the threaded plug with a fitted tool. Other plug mechanisms can be used and are considered within the scope of the invention.

Figure 9:
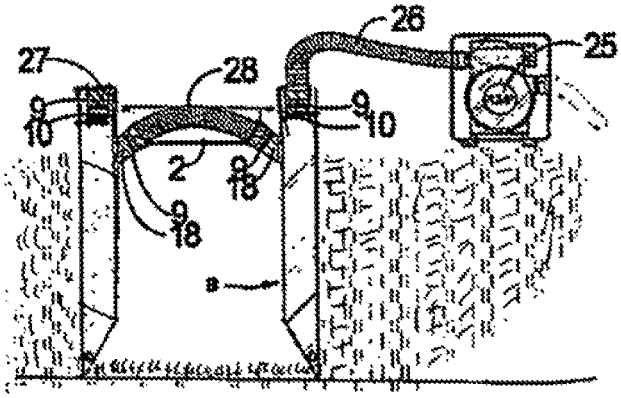
FIG. 9 is a view similar to FIG. 4 illustrating a pump connected to the present invention trench box with dewatering system and utilizing both walls with the pump.
Figure 10:
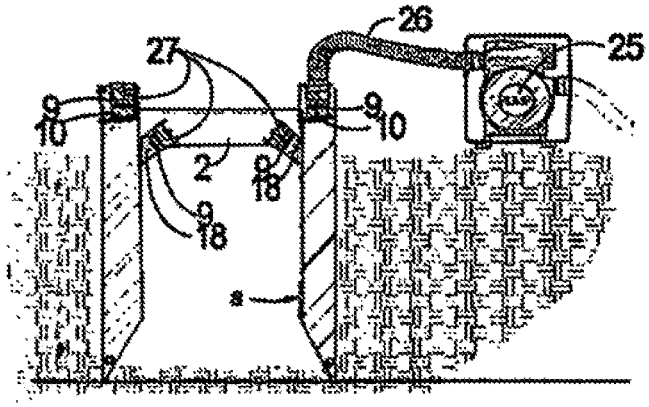
FIG. 10 is a view similar to FIG. 4 illustrating a pump connected to the present invention trench box with dewatering system and using a single wall with the pump.

FIGS. 9 and 10 illustrate non-limiting examples of types of pump connections to the dewatering system of the present invention. In one example, a single pump 25 of choice can be connected to the pump hose coupling 9 attached to the threaded pipe 10 at the top of a suction tube 8 on either wall with a suction hose 26, preferably rigid that is commonly used with water pumps. The coupling 9 on the opposite trench box wall that is not connected to the pump can be capped or plugged with a fitting 27 matching the style of coupling that is in use. The pump hose couplings that are attached to the angled threaded pipe 18 can be connected to each other with a second pump hose 28, which can be preferably a rigid pump hose. The length of pump hose 28 can be adjusted or selected to accommodate the length of the spreader bars 2 that are in use. The pump and hose arrangement of FIG. 9 utilizes the suction screens on both walls of the trench box with one pump. For conditions with more ground water that would require an additional pump, the cap or plug 27 can be removed and a second pump attached. The use of two pumps on this system is not illustrated, but the second pump would secure to coupling 9 on the second wall similar to how the first pump 25 is connected. For conditions with less ground water, the hose 28 connecting both walls of the trench box can be removed and caps 27 also placed on the inner couplings 9 as shown if FIG. 10 for the use with a single suction screen and wall with the pump.

Figure 11:
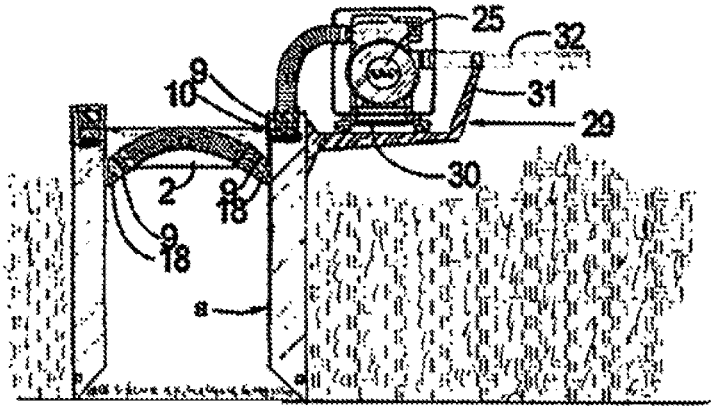
FIG. 11 is a view similar to FIG. 7 and FIG. 8 illustrating an optional/additional mounting plate to attach a pump to the present invention trench box walls.

FIG. 11 illustrates the addition of a mounting bracket 29 for the pump. The mounting bracket can attach to the outside and top of the trench box wall, near the end of the wall with the suction tube 8 and pump couplings 9 and can contain a plate 30 to attach a pump 25 to the mounting bracket. The plate can include holes or clamps on top to affix the base of the pump to the plate and preferably can be provided with a spring or shock system attached below the plate and connected to the mounting bracket. The mounting bracket can also be provided with an extension support 31 and cradle to hold a section of discharge pipe 32 connected to the pump. The pump attached to the trench box wall with the mounting bracket can be practical in conditions that would allow the trench box to be smoothly advanced with the trench excavation and would eliminate manually relocating the pump when needed. The mounting bracket can be constructed from various types of material that are sufficient to support a pump thereon and the mounting bracket is not considered limited to any particular material. Similarly, the mounting bracket is not limited to any specific size and should be sized sufficient to permit the pump to be disposed thereon.

To further reduce the amount of dirt, rocks, debris, etc. entering within the openings/slots in the front wall of the suction screen assembly, a screen member, similar to, but not limited to, a patio screen material, can be secured to the inner surface of the front wall within the internal cavity of the suction screen assembly.

Preferred materials for the pump mounting bracket can be without limitation, fabricated steel, preferably bolted to the trench box which would allow for removal if not needed and sized as needed to accommodate the base plates and mounting of various pumps that the operating conditions may require. The design can extend upward from the mounting bolts to locate the bottom of the pump preferably at or near the top of the trench box wall in order to clear the earth and any obstacle(s) at the top of the excavated trench.

It should be recognized that the various walls of the dewatering system of the present invention can be monolithically formed together or constructed integral and can also be monolithically formed or constructed integral with the trench box walls, especially where the dewatering system is included at the time of manufacture of the trench box.

All measurements, dimensions, angles, amounts, sizes, shapes, percentages, configurations, temperatures, component or part locations, securement or attachment mechanisms, sensing members, sealing members, numbers, ranges, frequencies, values, percentages, materials, orientations, methods of manufacture, etc. discussed above or shown in the drawing figures are merely by way of example and are not considered limiting and other measurements, dimensions, angles, amounts, sizes, shapes, percentages, configurations, temperatures, component or part locations, securement or attachment mechanisms, sensing members, sealing members, numbers, ranges, frequencies, values, percentages, materials, orientations, methods of manufacture, etc. can be chosen and used and all are considered within the scope of the invention.

Furthermore, one or more features or characteristics discussed for one embodiment of the present invention can also be used with another of the above discussed embodiments of the present invention.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A dewatering system for trench shoring equipment, comprising:

a suction screen assembly adapted for disposal along at least a portion of a bottom area of a piece of trench shoring equipment, said suction screen assembly defining an internal cavity and having a front wall containing a plurality of openings to permit fluid to enter into the internal cavity of the suction screen assembly;

a suction tube having an internal cavity which is in fluid communication with the internal cavity of the suction screen assembly, said suction tube extending upward with respect to said suction screen assembly, said suction tube having a first attachment member at an upper end of said suction tube, said first attachment member having an opening which is in fluid communication with the internal cavity of the suction tube, and a pump assembly having a water pump and hose, said hose attached at a first end to the water pump and at a second end to the first attachment member at the upper end of the suction tube, such that the hose is in fluid communication with the internal cavity of the suction tube;

wherein with the piece of shoring equipment disposed within a trench where water accumulates at the bottom of the trench the net pump is turned on and directs at least some of the water through the plurality of openings into the internal cavity of suction screen assembly then through the internal cavity of the suction tube then through the hose and into the water pump where the water exits through a discharge tube or discharge hose associated with the water pump;

wherein said suction tube has a second attachment member disposed at an inward angle with respect to the first attachment member toward an inside area of the trench, said second attachment member having an opening which is in fluid communication with the internal cavity of the suction tube at a point between the upper end of said suction tube and an opposite end of the suction tube.

2. The dewatering system for trench shoring equipment of claim 1 wherein said front wall of said suction screen assembly is disposed at an angle such that the front wall begins at a front area of the piece of shoring equipment and ends at a back area of the piece of shoring equipment.

3. The dewatering system for trench shoring equipment of claim 2 wherein said angle is approximately forty-five (app. 45°) degrees.

4. The dewatering system for trench shoring equipment of claim 1 wherein said suction screen assembly having a first end wall at one end of said front wall and a second end all at a second opposite end of said from wall, wherein at least one of said first end wall and said second end wall has an aperture and a removable plug inserted within said aperture; wherein access to the internal cavity of the suction screen assembly is provided upon removal of said plug from disposal within said aperture.

5. The dewatering system for trench shoring equipment of claim 4 wherein each end wall of said suction screen assembly has an aperture and associated plug.

6. The dewatering system for trench shoring equipment of claim 1 further comprising a second hose having a first end secured to the second attachment member and a second end adapted for securement to an attachment member of a second dewatering system to provide fluid communication between the internal cavity of the suction tube and an internal cavity of a suction tube associated with the second dewatering system; wherein activation of the water pump causes fluid to ultimately enter into the water pump and out a discharge tube or discharge hose associated with the water pump from both the internal cavity of the suction tube and the internal cavity of the suction tube associated with the second dewatering system.

7. The dewatering system for trench shoring equipment of claim 1 further comprising a bracket adapted for securement to an outer area of the trench shoring equipment; wherein said water pump is disposed on and supported by said bracket such that the water pump is off a ground area adjacent the trench.

8. The dewatering system for trench shoring equipment of claim 1 wherein said first attachment member is a cam lock coupling or a hose coupling.

9. The dewatering system for trench shoring equipment of claim 1 wherein said first attachment member is a first cam lock coupling or a first hose coupling and said second attachment member is a second cam lock coupling or a second hose coupling.

10. The dewatering system for trench shoring equipment of claim 1 wherein said suction screen assembly and said suction tube are adapted for retrofitting to an existing wall of the trench shoring equipment.

11. The dewatering system for trench shoring equipment of claim 1 wherein said suction screen assembly and said suction tube are incorporated into a wall of trench shoring equipment at the time of manufacturing of the trench shoring equipment to form a one-piece integrally formed member.

12. The dewatering system for trench shoring equipment of claim 1 wherein said front wall extending from the first side of the trench shoring equipment to a second side of the trench shoring equipment when the trench shoring equipment is positioned within a trench area, a first of said plurality of openings positioned adjacent a first end of the front wall of the suction screen assembly at or near the first side of the trench shoring equipment and a last of said plurality of openings positioned adjacent a second end of the front wall of the suction screen assembly at or near the first side of the trench shoring equipment.

13. The dewatering system for trench shoring equipment of claim 1 wherein said suction screen assembly is secured to the trench shoring equipment such that the suction screen assembly is positioned inward from a front area of the trench shoring equipment and does not extend into a trench area defined between the trench shoring equipment and a second trench shoring equipment.

14. A dewatering system for trench shoring equipment, comprising:

a suction screen assembly adapted for disposal along at least a portion of a bottom area a piece of trench shoring equipment, said suction screen assembly defining an internal cavity and having a front wall containing a plurality of openings to permit fluid to enter into the internal cavity of the suction screen assembly;

a suction tube having an internal cavity which is in fluid communication with the internal cavity of the suction screen assembly, said suction tube extending upward with respect to said suction screen assembly, said suction tube having a first attachment member at an upper end of said suction tube, said first attachment member having an opening which is in fluid communication with the internal cavity of the suction tube; and a pump assembly having a water pump and hose, said hose attached at a first end to the water pump and at a second end to the first attachment member at the upper end of the suction tube, such that the hose is in fluid communication with the internal cavity of the suction tube;

wherein with the piece of shoring equipment disposed within a trench where water accumulates at the bottom of the trench the water pump is turned on and directs at least some of the water through the plurality of openings into the internal cavity of the suction screen assembly then through the internal cavity of the suction tube then through the hose and into the water pump where the water exits through a discharge tube or discharge hose associated with the water pump;

wherein said suction screen assembly and said suction tube are monolithically formed as a one piece member.

15. A dewatering system for trench shoring equipment, comprising:

a suction screen assembly adapted for disposal along at least it portion of a bottom area of a piece of trench shoring equipment, said suction sun assembly defining an internal cavity and having a front wall disposed at an angle such that the front wall begins at a front area of the piece of shoring equipment and ends at a back area of the piece of shoring equipment, said front wall containing a plurality of openings to permit fluid to enter into the internal cavity of the suction screen assembly, said suction screen assembly has a first end wall at a first end of said front wall and a second end wall at an opposite end of said front wall, said first end wall having a first aperture and a first removable plug inserted within said first aperture and said second end wall having a second aperture and a second removable plug inserted within said second aperture; wherein access to the internal cavity of the suction screen assembly is provided upon removal of said first plug from disposal within said first aperture or upon removal of said second plug from disposal within said second aperture;

a suction tube having an internal cavity which is in fluid communication with the internal cavity of the suction screen assembly, said suction tube extending upward with respect to said suction screen assembly, said suction tube having a first attachment member at an upper end of said suction tube, said first attachment member having an opening which is in fluid communication with the internal cavity of the suction tube, said suction tube having a second attachment member disposed at an inward angle with respect to the first attachment member toward an inside area of a trench, said second attachment member having an opening which is in fluid communication with the internal cavity of the suction at a point between the upper end of said suction tube and an opposite end of said suction tube; and a pump assembly having a water pump and hose, said hose attached at a first end to the water pump and at a second end to the first attachment member at the upper end of the suction tube, such that the hose is in fluid communication with the internal cavity of the suction tube;

wherein with the piece of shoring equipment disposed within the trench where water accumulates at the bottom of the trench the water pump is turned on and directs at least some of the water through the plurality of openings into the internal cavity of the suction screen assembly then through the internal cavity of the suction tube then through the hose and into the water pump where the water exits through a discharge tube or discharge hose associated with the water pump.

16. The dewatering system for trench shoring equipment of claim 15 wherein said angle is approximately forty-five (app. 45°) degrees.

17. The dewatering system for trench shoring equipment of claim 15 wherein said first attachment member is a first cam lock coupling or a first hose coupling and said second attachment member is a second cam lock coupling or a second hose coupling.

18. The dewatering system for trench shoring equipment of claim 15 further comprising a second hose having a first end secured to the second attachment member and a second end adapted for securement to an attachment member of a second dewatering system to provide fluid communication between the internal cavity of the suction tube and an internal cavity of a suction tube associated with the second dewatering system; wherein activation of the water pump causes fluid to ultimately enter into the water pump and out a discharge tube or discharge hose associated with the water pump from both the internal cavity of the suction tube and the internal cavity of the suction tube associated with the second dewatering system.

19. The dewatering system for trench shoring equipment of claim 15 further comprising a bracket adapted for securement to an outer area of the trench shoring equipment; wherein said water pump is disposed on and supported by said bracket such that the water pump is off a ground area adjacent the trench.

20. A dewatering system for trench shoring equipment, comprising:

a suction screen assembly adapted for disposal along, at least a portion of a bottom area of a piece of trench shoring equipment, said suction screen assembly defining an internal cavity and having a front wall disposed at an angle of approximately forty-five (app. 45') degrees such that the front wall begins at a front area of the piece of shoring equipment and ends at a back area of the piece of shoring equipment, said front wall containing a plurality of openings to permit fluid to enter into the internal cavity of the suction screen assembly, said suction screen assembly has a first end wall at a first end of said front wall and a second end wall at an opposite end of said front wall, said first end wall having a first aperture and a first removable plug inserted within said first aperture and said second end wall having a second aperture and a second removable plug inserted within said second aperture; wherein access to the internal cavity of the suction screen assembly is provided upon removal of said first plug from disposal within said first aperture or upon removal of said second plug from disposal within said second aperture;

a suction tube having an internal cavity which is in fluid communication with the internal cavity of the suction screen assembly, said suction tube extending upward with respect to said suction screen assembly, said suction tube having a first cam lock or hose coupling at an upper end of said suction tube, said first cam lock or hose coupling having an opening which is in fluid communication with the internal cavity of the suction tube, said suction tube having a second cam lock or hose coupling disposed at an inward angle with respect to the first cam lock or hose coupling toward an inside area of a trench, said second cam lock or hose coupling having an opening which is in fluid communication with the internal cavity of the suction at a point between the upper end of said suction tube and an opposite end of said suction tube;

a pump assembly having a water pump and hose, said hose attached at a first end to the water pump and at a second end to the first attachment member at the upper end of the suction tube, such that the hose is in fluid communication with the internal cavity of the suction tube; and a bracket adapted for securement to an outer area of the trench shoring equipment;

wherein said water pump is disposed on and supported by said bracket such that the water pump is off a ground area adjacent the trench;

wherein with the piece of shoring equipment disposed within the trench where water accumulates at the bottom of the trench the water pump is turned on and directs at least some of the water through the plurality of openings into the internal cavity of the suction screen assembly then through the internal cavity of the suction tube then through the hose and into the water pump where the water exits through a discharge tube or discharge hose associated with the water pinup.

21. The dewatering system for trench shoring equipment of claim 20 further comprising a second hose having a first end secured to the second cam lock or hose coupling and a second end adapted for securement to an attachment member of a second dewatering system to provide fluid communication between the internal cavity of the suction tube and an internal cavity of a suction tube associated with the second dewatering system wherein activation of the water pump causes fluid to ultimately enter into the water pump and out a discharge tube or discharge hose associated with the water pump from both the internal cavity of the suction tube and the internal cavity of the suction tube associated with the second dewatering system.

* * * * *